US007418789B2

(12) United States Patent
Choi et al.

(10) Patent No.: US 7,418,789 B2
(45) **Date of Patent: *Sep. 2, 2008**

(54) COMBINATION DRYER AND METHOD THEREOF

(75) Inventors: Soung Bong Choi, Changwon-si (KR); Deug Hee Lee, Gimhae-si (KR); Byung Hwan Ahn, Gimhae-si (KR); Hung Myong Cho, Gyeongsangnam-do (KR); Young Soo Kim, Chongwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/269,882

(22) Filed: Nov. 9, 2005

(65) Prior Publication Data

US 2006/0130354 A1 Jun. 22, 2006

(30) Foreign Application Priority Data

Nov. 10, 2004 (KR) ..... 10-2004-0091272
Nov. 10, 2004 (KR) ..... 10-2004-0091273

(51) Int. Cl.
*F26B 11/02* (2006.01)

(52) U.S. Cl. ..... 34/380; 34/602

(58) Field of Classification Search ..... 34/134, 34/595, 601, 606, 602, 380
See application file for complete search history.

(56) References Cited

U.S. PATENT DOCUMENTS 2,178,048 A 10/1939 Mies
2,462,344 A 2/1949 Anderson
3,102,796 A 9/1963 Erickson
3,197,886 A * 8/1965 Brame et al. ..... 34/90
3,417,481 A 12/1968 Rumsey, Jr.
3,673,701 A 7/1972 Albertson
3,866,333 A * 2/1975 Sarukahanian et al. ..... 34/75
3,921,308 A 11/1975 Freze
4,103,433 A 8/1978 Taylor
4,189,341 A 2/1980 McPherson et al.
4,204,339 A 5/1980 Muller
4,516,331 A * 5/1985 Yamauchi et al. ..... 34/77
4,819,341 A * 4/1989 Gayso ..... 34/86
5,546,678 A 8/1996 Dhaemers
5,715,555 A 2/1998 Reber et al.
6,463,940 B1 10/2002 Thomas et al.
6,796,055 B2 9/2004 Baltes
6,868,621 B1 3/2005 Grimm et al.
6,904,703 B2 * 6/2005 Naganawa et al. ..... 34/596
6,928,752 B2 * 8/2005 Johnson et al. ..... 34/595
7,191,546 B2 3/2007 Maruca
2004/0088075 A1 5/2004 Batcher
2004/0154194 A1 8/2004 Prows (Continued)

FOREIGN PATENT DOCUMENTS

DE 3204718 8/1982

(Continued)

*Primary Examiner*—S. Gravini
(74) *Attorney, Agent, or Firm*—Ked & Associates, LLP

(57) ABSTRACT

A combination dryer and operation method are disclosed. The combination dryer and operation method for a combination dryer enable air in a drying drum and a cabinet for drying the laundry to circulate continuously and enable water generated in the circulation process to be used to perform a refreshing cycle.

21 Claims, 9 Drawing Sheets

U.S. PATENT DOCUMENTS

| | | | | |
|---|---|---|---|---|
| 2004/0194339 | A1 | 10/2004 | Johnson et al. | |
| 2006/0137206 | A1* | 6/2006 | Lee et al. | 34/86 |
| 2007/0169279 | A1 | 7/2007 | Park et al. | |

FOREIGN PATENT DOCUMENTS

| | | | |
|---|---|---|---|
| DE | 19810907 | | 9/1999 |
| DE | 19917206 | | 10/2000 |
| DE | 10-2005-053702 | | 6/2006 |
| EP | 1441059 | | 7/2004 |
| GB | 2 026 147 | * | 1/1980 |
| JP | 04-126198 | | 4/1992 |
| KR | 20-0243057 | | 10/2001 |
| WO | WO 97/10376 | | 3/1997 |
| WO | WO 2006/009375 | | 1/2006 |
| WO | WO 2006/025650 | | 3/2006 |
| WO | WO 2006/028326 | | 3/2006 |

* cited by examiner

COMBINATION DRYER AND METHOD THEREOF

This application claims the benefit of the Patent Korean Application No. P2004-91272 and p2004-91273 both filed on Nov. 10, 2004, which is hereby incorporated by reference as if fully set forth herein.

BACKGROUND OF THE INVENTION

1. Field of the Invention

The present invention relates to a combination dryer, and more particularly, to a new type of a combination dryer which enables air in a drying drum and a cabinet to circulate continuously for drying the laundry more smoothly and which is suitable for being built-in as well as preventing changes of interior environments.

2. Discussion of the Related Art

In general, a dryer is an electric home appliance which can dry cloth items, cloths and beddings (hereinafter, 'the laundry'). The dryer dries the laundry by supplying hot air to the washed laundry continuously.

FIG. 1 illustrates a conventional tumble dryer out of related art dryers.

The related art tumble dryer includes a body 101 a drying drum 20, a door 40, a motor 50, a drying heater 60 and a fan 70.

The body 10 defines an exterior of the tumble dryer and the drying drum 20 is rotatably mounted inside of the body 10.

Also, an opening 11 is formed in front of the body 10, and the door 40 is coupled for opening/closing the opening 11.

The motor 50 is secured to an inner downside of the body 10 for creating a driving force to rotate the drying drum 20 and the fan 70.

The drying heater 60 is mounted on an inner portion of a hot air supply channel 91 for heating air flowing within the hot air supply channel 91. The hot air supply channel 91 guides a hot air passage supplied into the drying drum 20.

The fan 70 discharges dry air flowing inside of the drying drum 10 to an outside, and is provided in communication with a hot air discharge channel 92.

Thus, once the fan 70 is put into operation, external air is guided by the hot air supply channel 91 and heated by passing through the drying heater 60 to be drawl into the drying drum 10.

Thereby, the damp laundry introduced into the drying drum 10 is getting dried by the heated external air gradually.

The air having dried the laundry by being circulated within the drying drum 10 is guided by the hot air supplying channel 92 to be discharged outside.

Once drying is completed by the repeated performance of the above process, the fan 70 and the drying heater 60 are stopped to finish a drying cycle.

However, the related art tumble dryer has a problem that a tangled portion of the laundry is not dried smoothly, because the drying cycle is performed in a state of the laundry being introduced together at one time.

There is another problem that it is impossible to keep the laundry for a long time in the related art tumble dryer.

Thus, recently demands have been increasing accordingly for a new type of a combination dryer having a drying capacity thereof enlarged as well as capable of keeping the laundry for a long time. There are various combination dryers provided with tumble dryers having auxiliary cabinet dryers provided therewith, for example, U.S. Pat. No. 2004-0194339 A1 or U.S. Pat. No. 2004-0154194.

The above combination dryer has a cabinet dryer provided on a top of a conventional dryer having a rotatory drum. The cabinet dryer has space for the laundry and receives hot air used to dry or keep the laundry for a long time.

The cabinet dryer is employed to dry the laundry or keep the laundry therein for a long time after receiving hot air from the tumble dryer.

However, the combination dryer described above may cause a problem that the combination dryer cannot be supplied for being built-in, because the air having dried the laundry is discharged outside of the combination dryer.

That is, since space for being built-in should be formed large enough to maintain a sufficient distance with a wall for discharging air smoothly, a design of an exterior may deteriorate.

Furthermore, since the air discharged from the combination dryer is a high-temperature humid air, internal environment may not be the high temperature humid one which a user does not want.

SUMMARY OF THE INVENTION

Accordingly, the present invention is directed to a combination dryer and a method thereof that substantially obviates one or more problems due to limitations and disadvantages of the related art.

An object of the present invention is to provide a combination dryer that enables air for drying in a tumble dryer and a cabinet dryer to be circulated continuously, such that changes of interior environment are prevented for being built-in.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a controlling method of a combination dryer comprises a controlling process for selectively operating a drying cycle and a refreshing cycle. The refreshing cycle includes a step of supplying condensed water stored in the condensed water storing chamber into a heating part: a step of generating steam for generating steam by evaporating the condensed water of the heating part: and a step of supplying steam for supplying the steam into the drying drum and/or the laundry keeping space.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
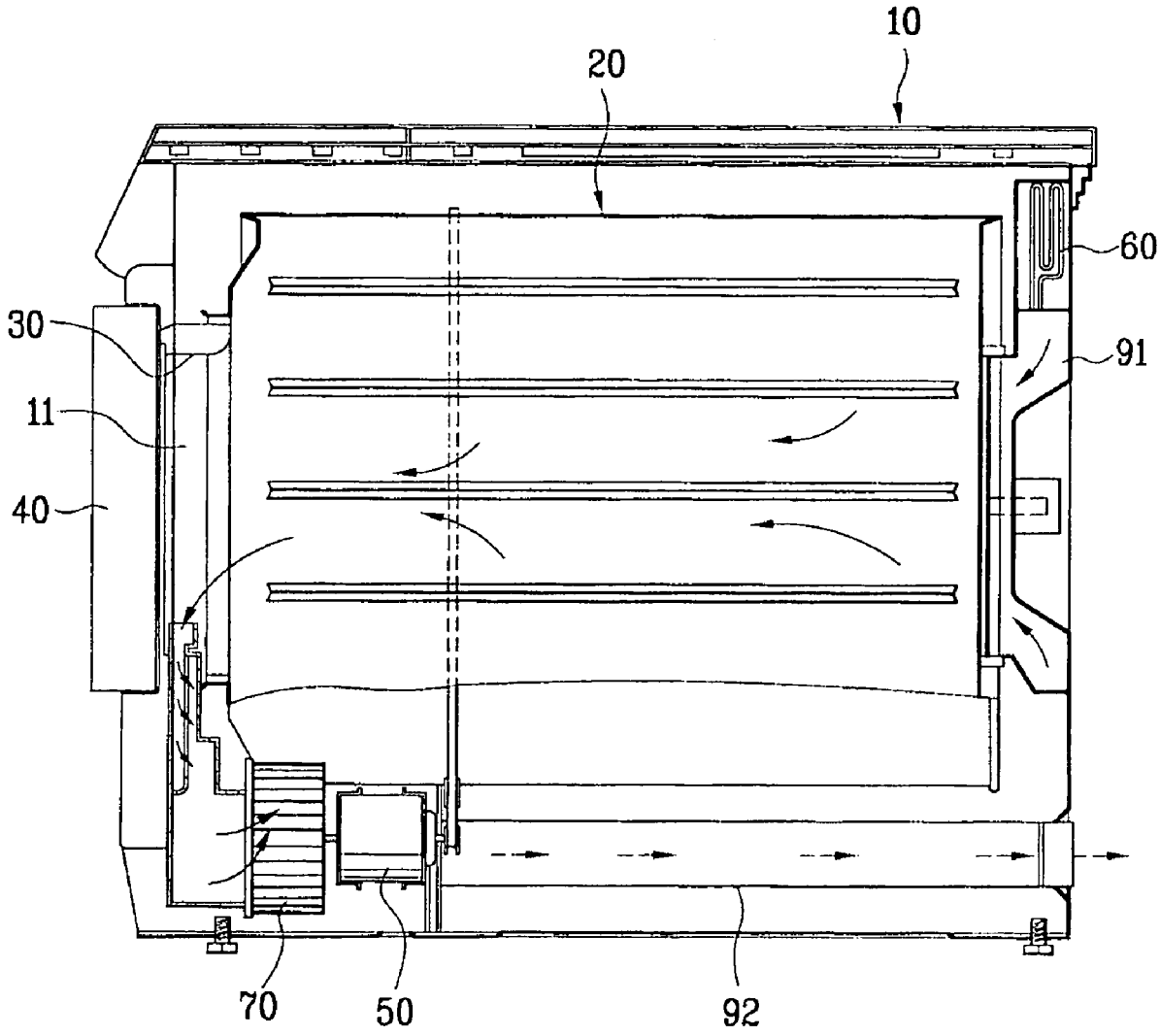
FIG. 1 is a diagram illustrating an inner structure of a conventional tumble dryer.
Figure 2:
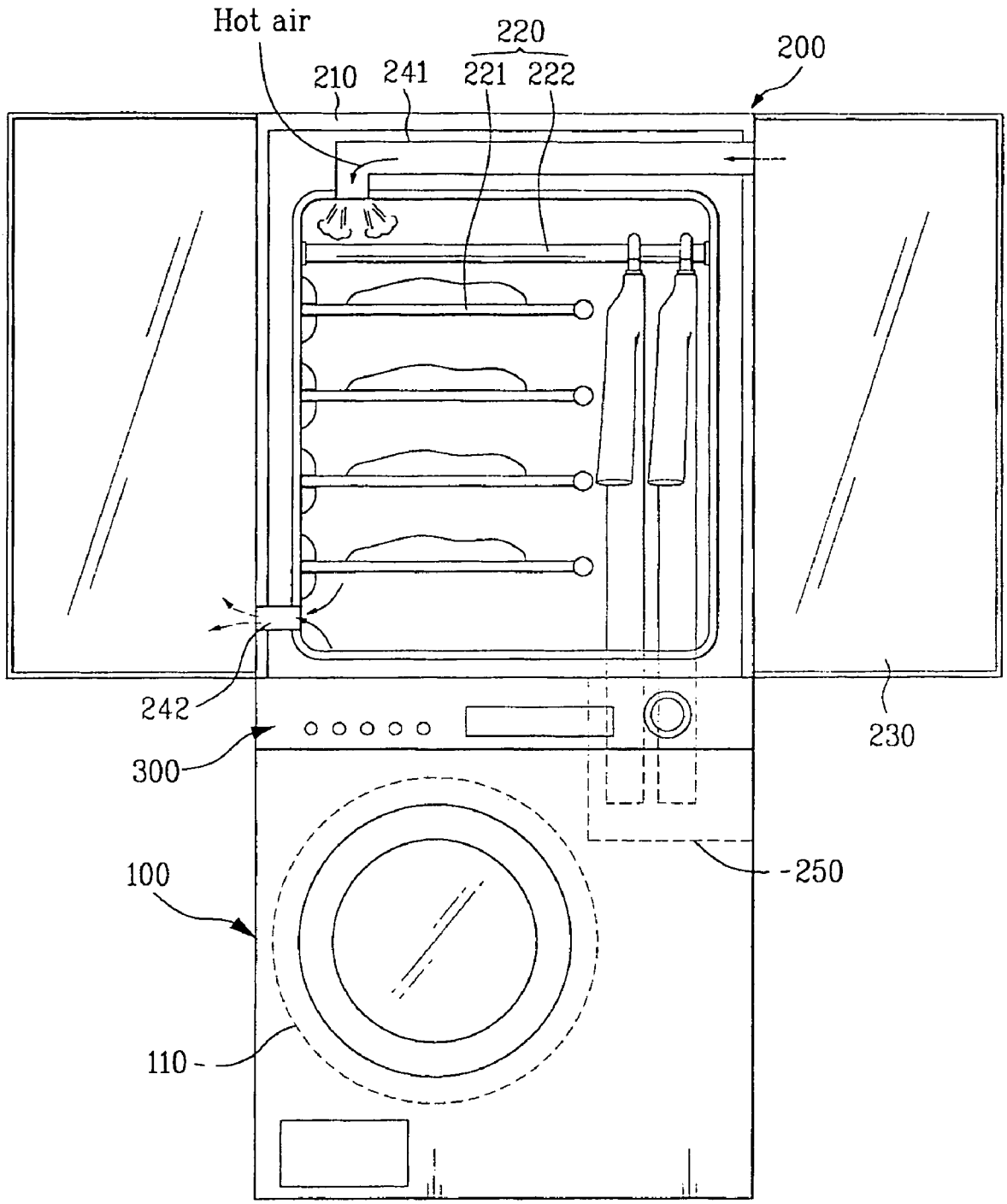
FIG. 2 is a diagram schematically illustrating an exterior of a combination dryer according to a first embodiment of the present invention.
Figure 3:
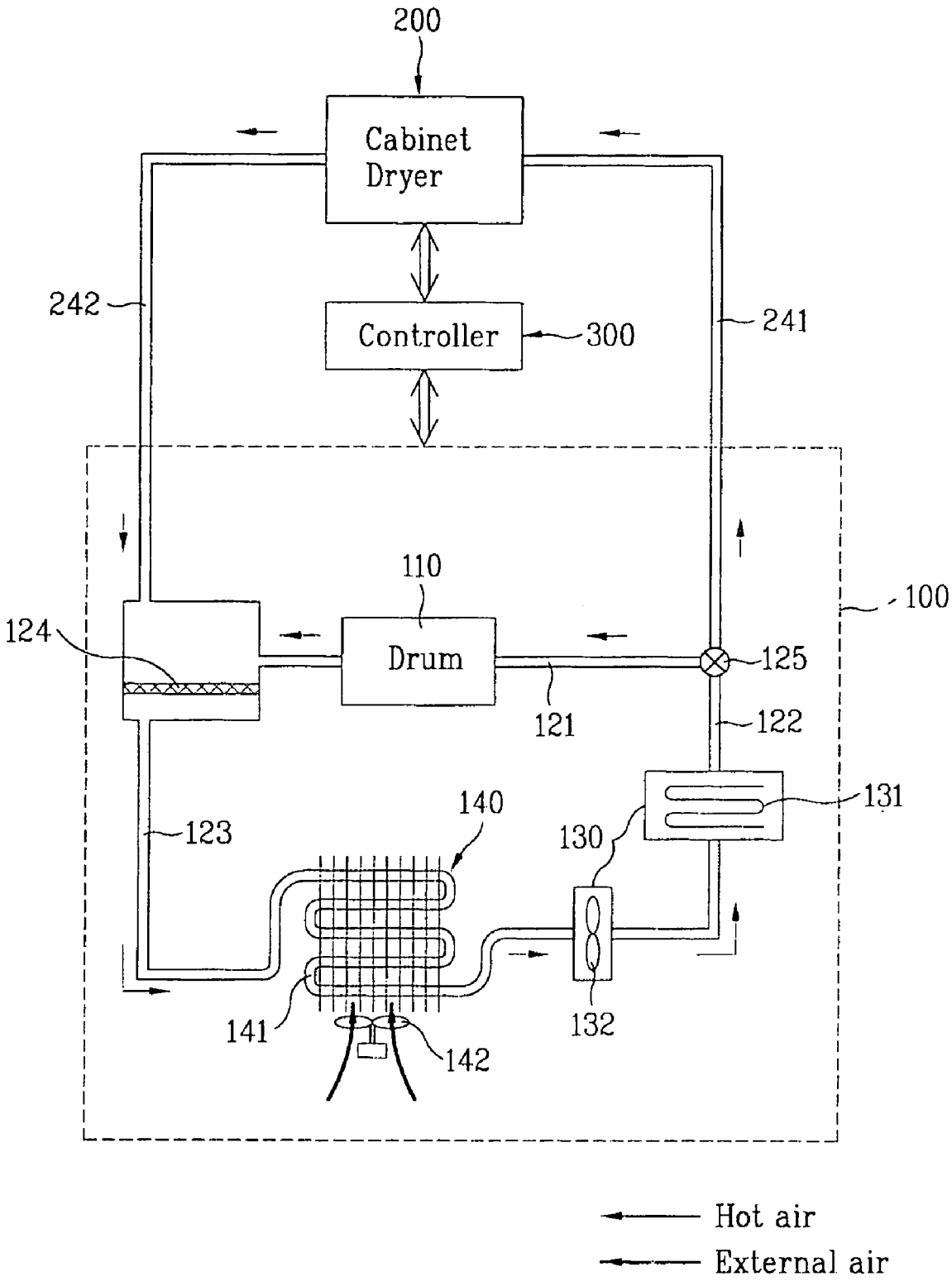
FIG. 3 is a block diagram schematically illustrating, the combination dryer according to the first embodiment of the present.
Figure 4:
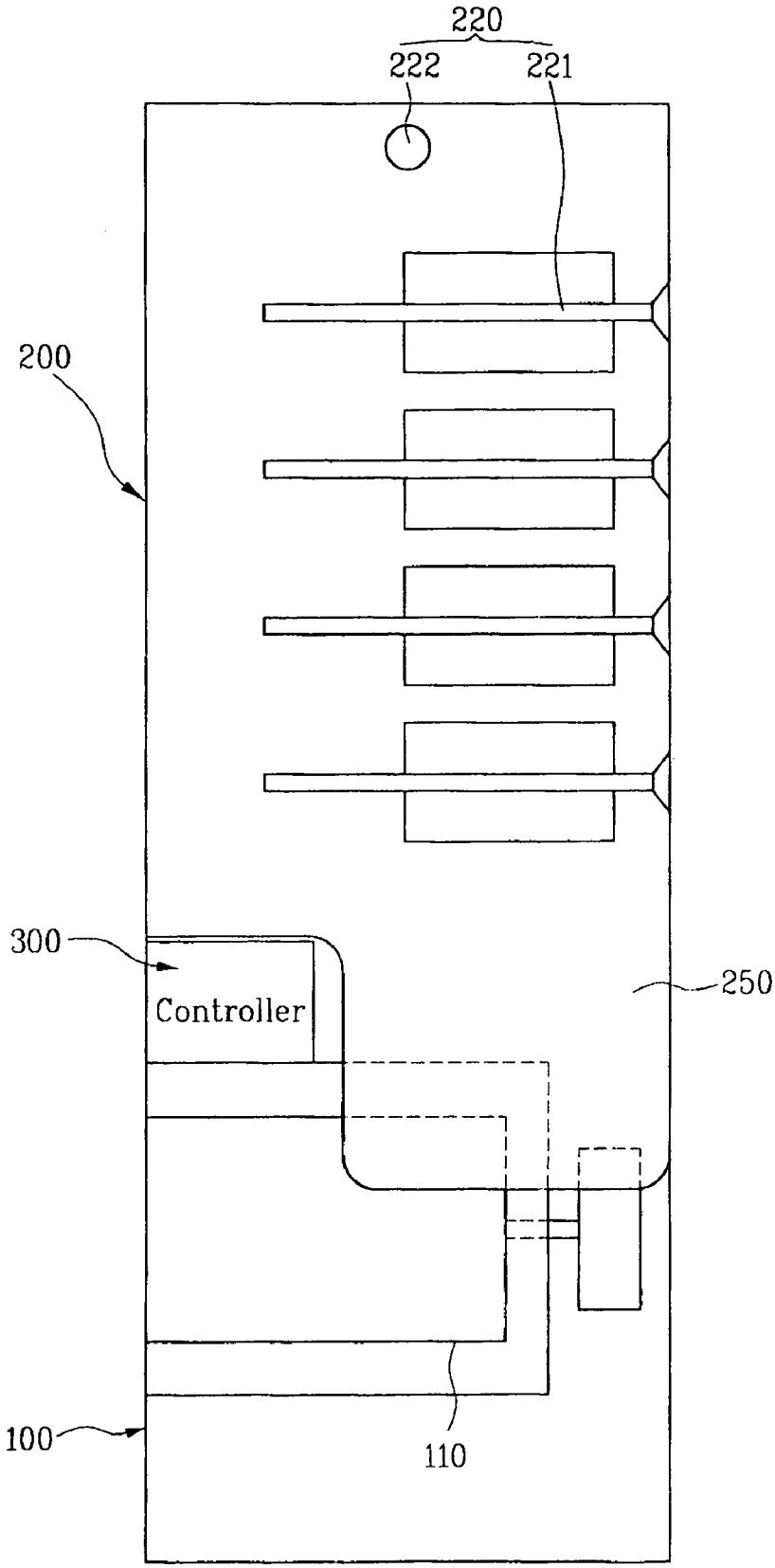
FIG. 4 is a sectional view from a side illustrating an extending part of a cabinet dryer of the combination dryer according to the first embodiment of the present invention.

As shown in FIGS. 2 to 4, a combination dryer according to a first embodiment of the present invention includes a tumble dryer 100, a cabinet dryer 200, and a controller 300.

The tumble dryer 100 performs only a drying cycle of the laundry. The tumble dryer 100 includes a drying drum 110 capable of rotating and agitating, a hot air supplying pipe, a hot air supplying part 130, and an air condensing part 140.

The hot air supplying pipe as a pipe guiding an inflow of high-temperature hot air is connectedly in communication with inside space of the drying drum 110, the air condensing part 140 and a cabinet dryer 200.

The hot air supplying pipe includes a first supplying pipe 121 for supplying hot air into the drying drum 110, a second supplying pipe 122 for receiving and supplying the air having passed through the air condensing part 140 to the first supplying pipe 121, and a third supplying pipe 123 for receiving and transmitting the air discharged from the drying drum 110 to the air condensing part 140.

A filtering part 124 may be further provided in the third supplying pipe 123 for filtering foreign substances contained in the flowing air.

Also, the hot air supplying part 130 is provided in the second supplying pipe 122 for generating hot air.

The hot air supplying part 130 includes a drying heater 131 for heating the air flowing inside of the second supplying pipe 122, a fan 132 for forcibly ventilating the air within the second supplying pipe 122.

Preferably, the fan 132 is provided in a portion of the second supplying pipe 12 where air is drawn into the drying heater 131.

That is for minimizing damage of the fan 132 due to hot air.

Also, the air condensing part 140 condenses the air flowing along the hot air supplying pipe to radiate heat of the air. The air condensing part 140 includes a condenser 141 and an air condensing fan 142.

The condenser 141 receives the hot air from the third supplying pipe 123, and includes a pipe having a plurality of branched portions and a cooling pin.

The air condensing fan 142 ventilates external air toward the condenser 141.

Thus, the humid air passing through the condenser 141 is condensed through heat-exchanging with external air supplied by driving of the air condensing, fan 142, while flowing along a pipe way of the condenser 141.

The cabinet dryer 200 is mounted on a top of the tumble dryer 100, with a predetermined space having lots of the laundry kept therein.

The cabinet dryer 200 includes a body 210, a keeping the laundry space 220, an opening/closing door 230, a hot air inlet pipe 241, and an air outlet pipe 242.

The body 210 defines an exterior of the cabinet dryer 200, and is formed to allow a front thereof to be opened.

An extending part 250 may be further provided in the body 210 for extending to reach an inside of the tumble dryer 100.

The extending part 250 is employed for hanging the long laundry such as pants or a coat so that the long laundries may not overlap one another, and preferably extends toward one side so as not to affect rotation of the drying drum 110.

Also, the laundry keeping space 220 forms space for keeping the laundry, and includes a plurality of racks 221 and a bar 222.

At that time, each rack 221 is detachable from the body 210 and formed for seating various kinds of the laundries thereon. The bar 222 is coupled along a front and a rear of a first side of upper space within the body 210.

The opening/closing door 230 is employed for opening/closing the opened front of the body 210.

A first end of the hot air inlet pipe 241 is connected to a portion of the second supplying pipe 122 where air is discharged, and a second end thereof is connectedly in communication with the space 220 keeping the laundry therein for transmitting the hot air from the second supplying pipe 122 into the space 220 keeping the laundry therein.

Preferably, an air channel valve 125 may be further provided in the second supplying pipe 122 for choosing and guiding a direction of the air flowing into the first supplying pipe 121 and/or the hot air inlet pipe 241.

Also, a first end of the air outlet pipe 242 is in communication with the laundry keeping space 220, and a second end thereof is connected to the third supplying pipe 123 to discharge the high-temperature humid air having passed through the laundry within the space 220.

At that time, an auxiliary exhaustion fan (not shown) may be further provided in the air outlet pipe 242.

The controller 300 according to the present invention controls operations of the tumble dryer 100 and the cabinet dryer 200.

At that time, the controller 300 may be provided in at least one of the tumble dryer 100 and the cabinet dryer 200 and it is preferred but not necessary that the controller 300 is provided only in the tumble dryer as shown in embodiments of the present invention.

If the controller 300 is provided in both the tumble dryer 100 and the cabinet dryer 200, the control parts 300 are connected by a data cable (not shown) to make possible to intercommunicate information.

Also, the controller 300 may control the tumble dryer 100 and the cabinet dryer 200 respectively, and may control the tumble dryer 100 and the cabinet dryer 200 to communicate each other.

A controlling process of a combination dryer according to the present invention will be described.

Once a drying cycle is required through the controller 300, the controller 300 identifies an object of the drying cycle. According to the results of the identification, each various controlling process is performed.

The identification of the object is to identify whether only the tumble dryer 100 performs a drying cycle, or only the cabinet dryer 200 performs a drying cycle, or both of the tumble dryer 100 and the cabinet dryer 200 perform each drying cycle.

Figure 5:
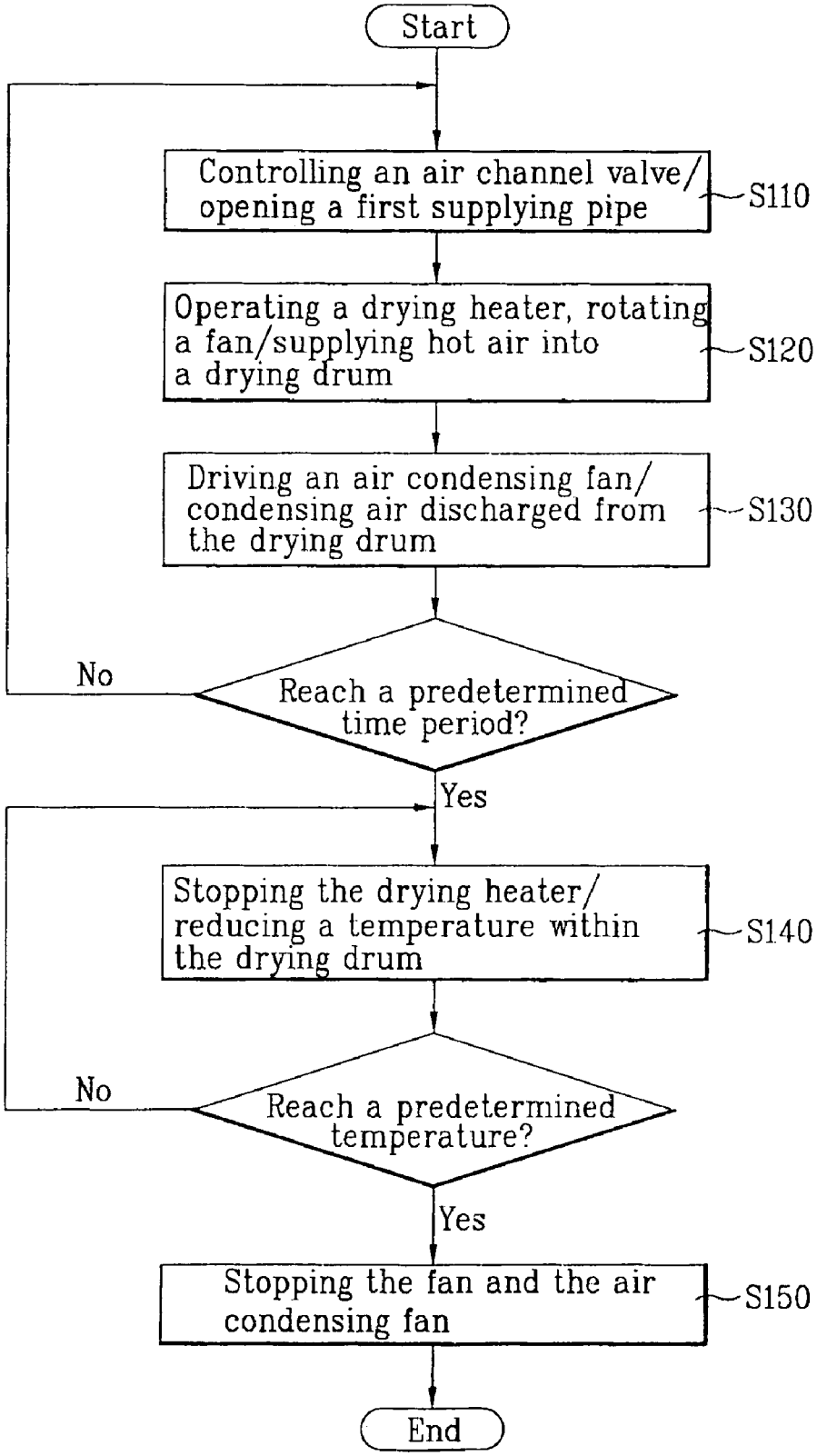
FIGS. 5 to 7 are flow charts schematically illustrating a controlling process of the combination dryer according to the first embodiment of the present invention.

First of all, referring to the flow chart of FIG. 5, a controlling process in case that the object of the drying cycle is identified to be only the tumble dryer 100 will be described.

If the object of the drying cycle is identified to be only the tumble dryer 100, an air channel valve 125 is controlled so as to have hot air flow into a first supplying pipe 121(S110). That is, the hot air is prevented from flowing into the hot air inlet pipe 241.

Under that condition, the drying heater 131 is controlled to be heated. Hence, the air flowing within the second supplying pipe 122 is heated.

Also, the fan 132 is controlled to rotate. Hence, the hot air within the second supplying pipe 122 is supplied into the drying drum 110 of the tumble dryer 100 through the first supplying pipe 121 (S120).

The hot air within the drying drum 110 is supplied to the laundry within the drying drum 110 for drying the laundry, and continuously discharged to an outside of the drying drum 110 through the third supplying pipe 123.

At that time, the hot air discharged to an outside of the drying drum 110 contains much moisture, as well as the temperature thereof being reduced.

Thus, the air containing the much moisture passes through the condenser 141 along the third supplying pipe 123.

At that time, driving of the air condensing fan 142 is controlled. Hence, external air is ventilated toward the condenser 141. Then, the humid air passing through the condenser 141 heat-exchanges with the external air to be condensed (S130). Thus, the air becomes dry.

The dry air having passed through the air condensing part 140 is re-drawn into the second supplying pipe by driving the fan 132, and passes through the drying heater 131.

Thereby, hot air is continuously created, and the created hot air is supplied into the drying drum 110 to perform a drying cycle repeatedly.

Although the user may stop the drying cycle described above at his/her discretion, preferably the drying cycle is performed repeatedly for a predetermined time period.

If the drying cycle is performed only for the predetermined time period, it is preferred but not necessary that in a state of stopping the drying heater 131, not stopping all operations temporarily, air not heated is circulated to reduce a temperature of the drying drum 110(S140).

That is, controlling to continuously drive the fan 132 and the air condensing fan 142 enables the temperature of the drying drum 110 to reach a safe temperature more quickly.

That control may be performed until the temperature of the drying drum 110 reach a predetermined temperature, or continuously performed during the predetermined time period.

Once the temperature of the drying drum 110 reaches the predetermined temperature, the fan 132 and the air condensing fan 142 are stopped (S150), to finish the drying cycle.

Figure 6:
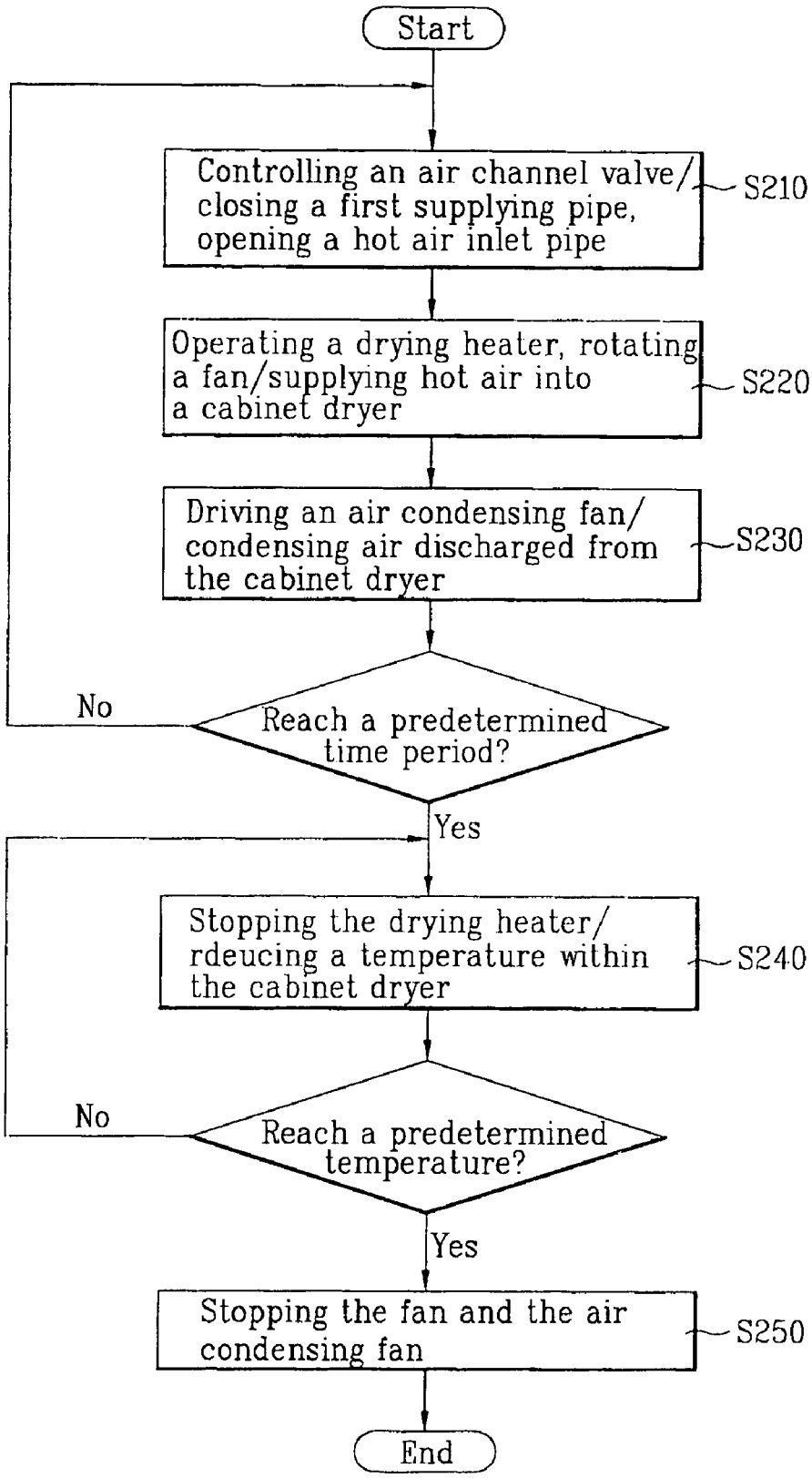

Next, referring to a flow chart of FIG. 6, a controlling process in case the object of the drying cycle is identified to be only the cabinet dryer will be described in detail.

First of all, once the object for drying cycle is identified to be only the cabinet dryer 200, the air channel valve 125 is controlled so as to make the hot air flow only into the hot air inlet pipe 241 (S210). That is, the hot air is not flown into the first supplying pipe 121.

In that state, the drying heater 131 is controlled to radiate heat for heating the hot air within the second supplying pipe 122.

Also, at that time, the fan 132 is controlled to rotate. Hence, the high temperature air, in other words, the hot air within the second supplying pipe 122 is supplied into the laundry keeping space 220 of the cabinet dryer 200 through the hot air inlet pipe 241 (S220).

Thus, the hot air is supplied to the laundry within the laundry keeping space 220 to dry the laundry, and then is transmitted to the third supplying pipe 123 through the air outlet pipe 242, after being discharged outside of the dryer 200.

The hot air discharged outside of the space 220 may contain a large quantity of moisture, as well as the temperature thereof is reduced, while passing through the laundry.

Hence, the air with much moisture passes through the condenser 141 of the air condensing part 140 along the third supplying pipe 123.

At that time, the driving of the condensing fan is controlled. Thereby, external air is drawn toward the condenser 141 and the humid air passing through the condenser 141 heat-exchanges with the external air to be condensed (S230). Thus, the air becomes dry.

Continuously, the dry air having passed through the air condensing part 140 is re-drawn into the second supplying pipe 122 by driving the fan 132, and then passes through the drying heater 131.

Thereby, hot air is generated repeatedly and also the generated hot air is supplied into the laundry keeping space 220 to dry the laundry repeatedly.

The drying cycle described above may be stopped by the user at his/her discretion, and preferably the drying cycle is repeated for a predetermined time period.

In case the drying cycle is performed for the predetermined time period, preferably it is better to control to reduce the temperature in the laundry keeping space 220 by circulating the air which is not heated in a state of stopping only the drying heater 131's radiating heat (S240) than to stop all of the functions temporarily.

That is, preferably controlling to drive the fan 132 and the air condensing fan 142 repeatedly allows the temperature of the space 220 to reach a safe temperature more quickly.

Preferably, that controlling is performed repeatedly until the temperature of keeping space 220 reaches the predetermined temperature, or during the predetermined time period.

Once the temperature of the drying drum 110 reaches the predetermined temperature, the fan 132 and the air condensing fan 142 are stopped (S250) to complete the drying cycle.

Figure 7:
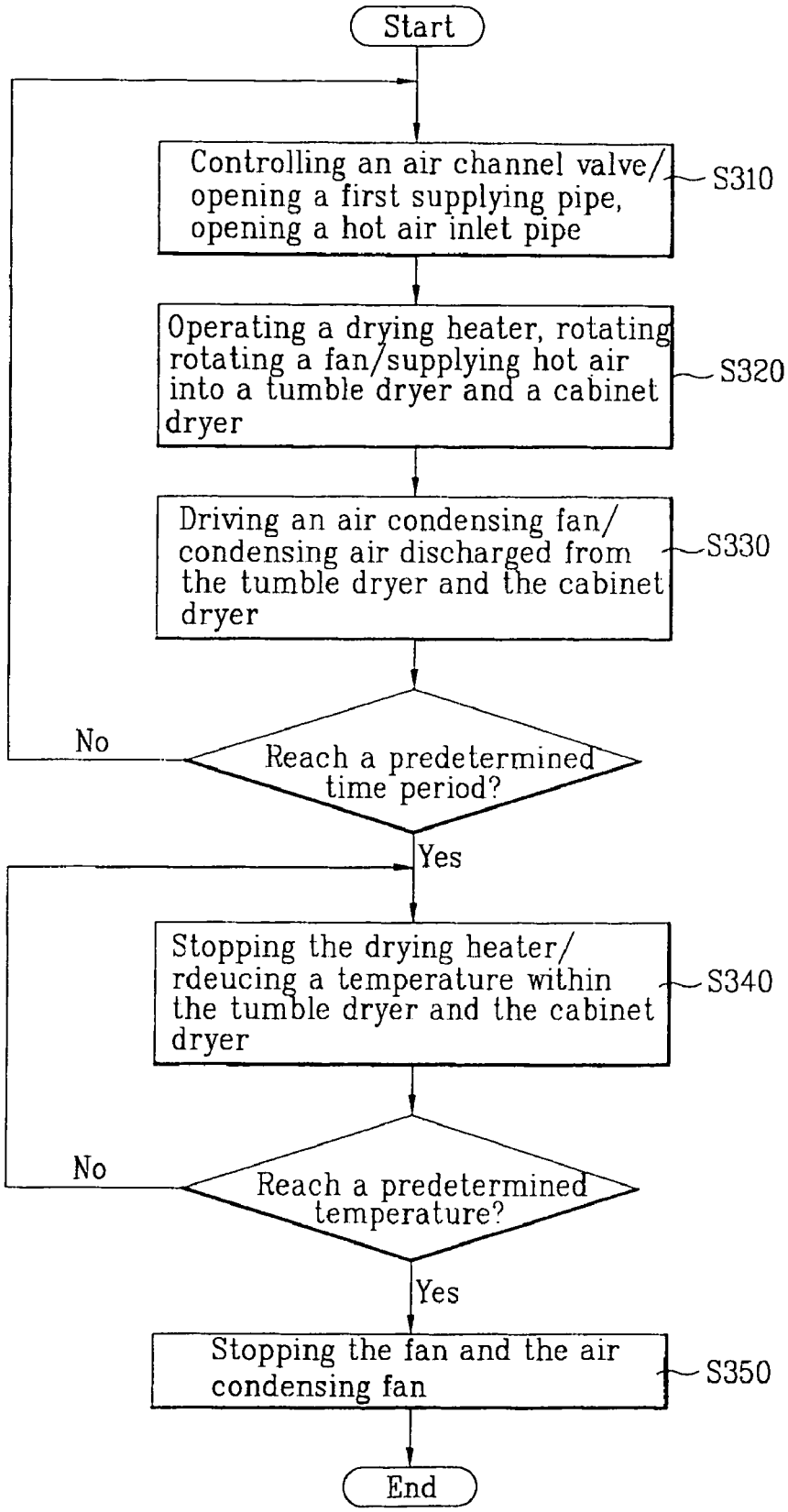

Next, referring to the flow chart of FIG. 7, a controlling process in case the object of the drying cycle is identified to be both of the tumble dryer 100 and the cabinet dryer 200 will be described in detail.

First of all, once the object of the drying cycle is identified to be the tumble dryer 100 and the cabinet dryer 200, the air channel valve 125 is controlled so as to help hot air flow into both of the first supplying pipe 121 and the hot air inlet pipe 141 (S310).

In that state, the drying heater 131 is controlled to radiate heat, and then the air within the second supplying pipe 122 is heated.

Also, at that time, the fan 132 is controlled to rotate. Hence, the hot air within the second supplying pipe 122 is supplied into the drying drum 110 of the tumble dryer 100 and the laundry keeping, space 220 of the cabinet dryer 200 through the first supplying pipe 121 and the hot air inlet pipe 241 (S320).

The hot air within the drying drum 110 and the laundry keeping space 220 is supplies to the laundry within the drying drum 110 and the laundry keeping, space 220 to dry the laundry, and continuously discharged outside of the drying drum 110 and the cabinet dryer 200 through the third supplying pipe 123 and the air outlet pipe 242.

The air discharged through the air outlet pipe 242 is transmitted to the third supplying pipe 123, and then meets the air flowing along the third supplying pipe 123.

At that time, the hot air discharged outside of the drying drum 110 and the laundry keeping space 220 has the temperature thereof reduced in the middle of passing through the laundry, and maintains a large quantity of moisture.

Thus, the air having much moisture passes through the condenser of the air condensing part 140 along the third supplying pipe 123.

At that time, the driving of the air condensing fan 142 is controlled. Thereby, external air is drawn toward the condenser 141, and the humid air passing through the condenser 141 exchanges heat with the external air to be condensed. Thereby, the air becomes dry.

The dry air having passed through the air condensing part 140 is re-drawn into the second supplying pipe 122 by the repeated driving of the fan 132, and after that passes through the drying heater 131.

Thereby, hot air is created repeatedly, and also the generated hot air is supplied into the drying drum 110 and the laundry keeping space 220 through the first supplying pipe 121 and the hot air inlet pipe 241 so as to perform a drying cycle for the laundry repeatedly.

The drying cycle for the laundry described above may be stopped by the user at his/her discretion, and it is preferred but not necessary that the drying cycle is performed for the predetermined time period repeatedly.

Preferably, in case the drying cycle is performed for the predetermined time period, it is better to circulate the air not heated for reducing the temperature of the drying drum 110 and the laundry keeping space 220 in a state of stopping the drying heater 131 (S320) than to stop all of the functions temporarily.

That is, the fan 132 and the air condensing fan 142 may be controlled to drive continuously so as to help the temperature of the drying drum 110 and the laundry keeping space 220 reach a safe temperature more quickly.

Controlling the fan 132 and the air condensing fan 142 to drive continuously may be performed until the temperature of the drying drum 110 and the space 220 reach the predetermined temperature by identifying the temperature repeatedly, or during the predetermined time period.

Once the temperature of the drying drum 110 reach the predetermined temperature, the fan 132 and the air condensing fan 142 are stopped (S350) to complete the drying cycle.

Figure 8:
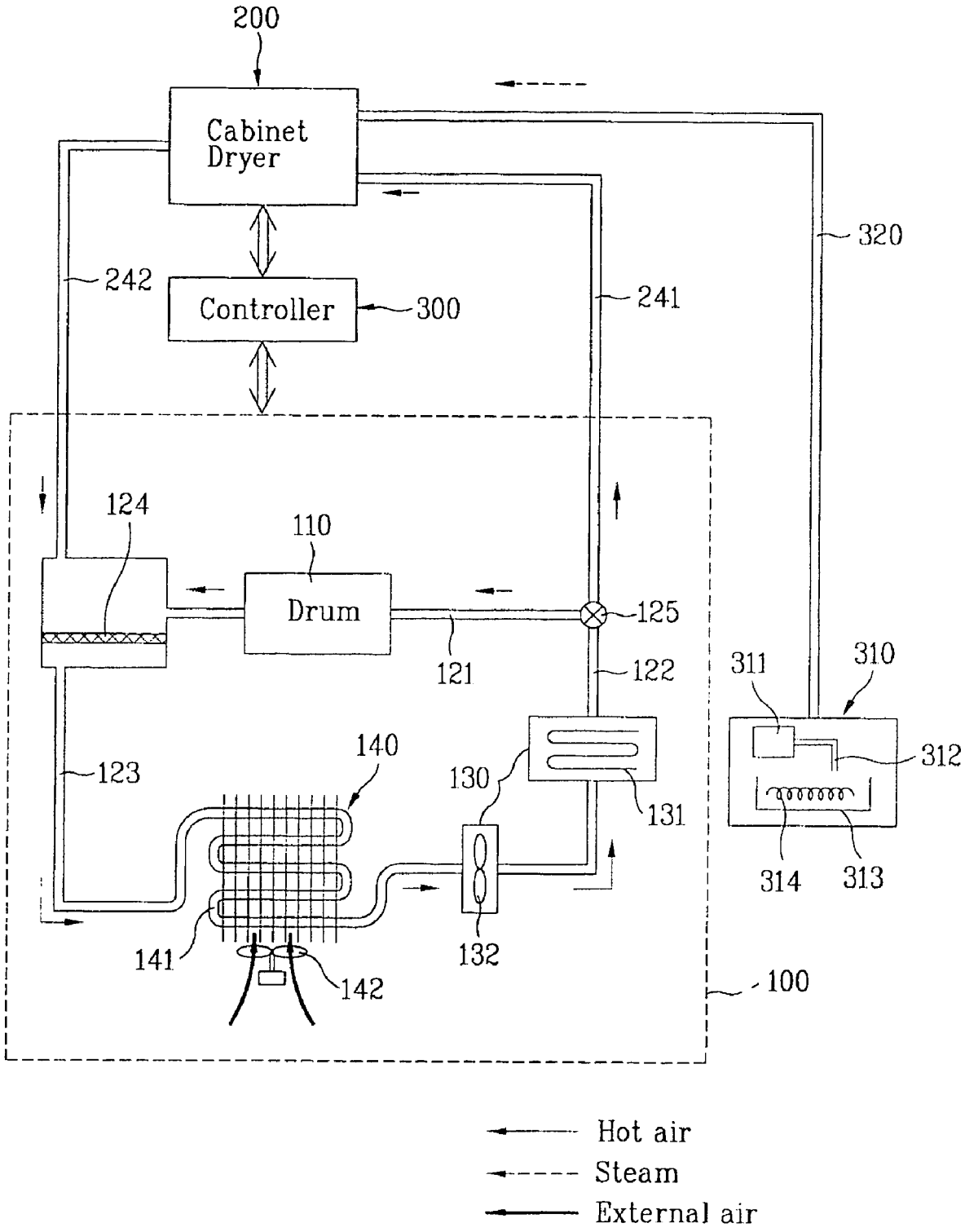
FIG. 8 is a block diagram schematically illustrating a combination dryer according to a second embodiment of the present invention.

On the other hand, FIG. 8 shows a combination dryer according to a second embodiment of the present invention.

That is, according to the second embodiment of the present invention, a steam generating part 310 is further provided for generating steam. Also, inner space of the steam generating part 310 and the cabinet dryer 200 is connected by a steam supplying pipe 320.

The steam generating part 310 supplies steam to the laundry kept within the cabinet dryer 200 to have the laundry refreshed, and is provided in at least one of the tumble dryer 100 and the cabinet dryer 200.

The steam generating part 310 includes a water chamber 311 for storing water to generate steam, a water supplying pipe 312 connected to the water chamber 311 for receiving water from the water chamber 311 a heating part 313 having predetermined space for storing the water received from the water supplying pipe 312, and heating element 314 provided within the heating part 313 for heating and evaporating the water into steam.

The water chamber 311 may be connected to the water pipe for receiving water, or the user may supply water to the water chamber 311 directly.

Alternatively, as not shown the steam generated in the steam generating part 310 may be supplied to the tumble dryer 100.

A refreshing cycle in the combination dryer according, to the second embodiment of the present invention will be described.

First, in case of performing a refreshing cycle such as smoothing out wrinkles and sterilizing the laundry, the steam generating part 310 is operated for generating steam.

In other words, the water supplied to the heating part 314 from the water chamber 311 is evaporated by heating the heating element 314 for generating steam.

The steam generated in the steam generating part 310 is supplied into the laundry keeping space 220 of the cabinet dryer 200 through the steam supplying pipe 320.

Hence, the refreshing cycle is performed for the laundry kept within the space 220 of the cabinet dryer 200.

On the other hand, the steam generating part 310 according to the second embodiment of the present invention may cause a problem that the user should supply water for generating steam consistently.

Furthermore, the first embodiment of the present invention may cause a problem that an auxiliary structure is needed for draining the condensed water, because the air condensing part 140 according to the first embodiment is operated for condensing hot humid air to generate much condensed water.

Therefore, a technical feature according to a third embodiment of the present invention is that the condensed water generated in the air condensing part is used to generate steam.

Figure 9:
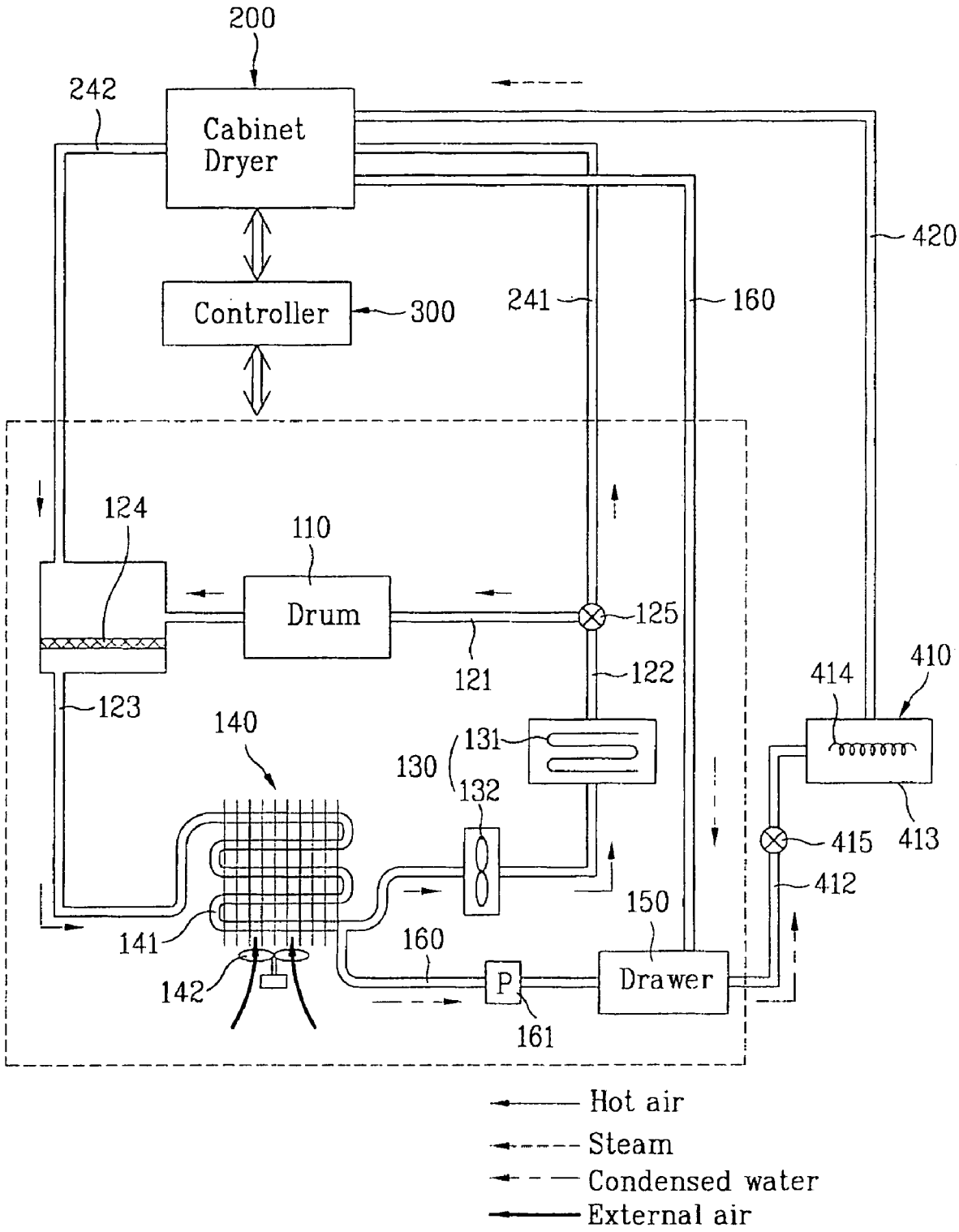
FIG. 9 is a block diagram schematically illustrating the combination dryer according to a third embodiment of the present invention.

That is, as shown in FIG. 9, according to a combination dryer of the third embodiment, a condensed water storing chamber 150 is further provided in the combination dryer of the first embodiment. The condensed water storing chamber 150 is connected to the air condensing part 140, the cabinet dryer 200 and the drain pipe 160.

The condensed water generated in the air condensing part 140 and in the cabinet dryer 200 is drawn into the condensed storing chamber 150 through the drain pipe 160.

Preferably, a pump 161 is further provided in the drain pipe 160 for forcibly pumping the condensed water to transmit the condensed water to the condensed water storing chamber 150.

Also, the combination dryer of the third embodiment further includes a steam generating part 410 for generating steam after receiving the condensed water stored in the condensed water storing chamber 150, and a steam supplying pipe 420 for supplying the steam generated in the steam generating part 410 to the cabinet dryer 200.

At that time, the steam generating part 410 is provided in either of the tumble dryer 100 and the cabinet dryer 200, and includes a condensed water supplying pipe 412 for receiving water from the condensed water storing chamber 150, a heating part 413 having a storing space for contemporarily storing the water received through the condensed water supplying pipe 412, and a heating element 414 provided within the heating part 413 for heating and evaporating the stored water into steam.

Especially, it is preferred but not necessary that an opening/closing valve 415 is further provided in the condensed water supplying pipe 412 for selectively opening/closing the inflow of the water supplied into the heating part 414.

A refreshing cycle of the combination dryer according to the third embodiment of the present invention will be described.

First, when operating a refreshing cycle such as smoothing out wrinkles or sterilizing the laundry, an air passage of the condensed water supplying pipe 412 is opened by controlling of the opening/closing valve 415 for supplying the water n the condensed storing chamber 150 to the heating part 413.

Also, heating the heating part 414 evaporates the water supplied to the heating part 413 for generating steam.

At that time, the steam generated within the heating part 413 is supplied into the laundry keeping space 220 of the cabinet dryer 200 through the steam supplying pipe 420.

Thus, the laundry within the space 220 is refreshed by the hot steam.

Also, preferably the fan 132 is driven for helping the hot humid air within the cabinet dryer 200 flown into the condenser 141.

Hence, condensed water is regularly supplied into the condensed water storing chamber 150, and steam is generated by using the condensed water without difficulty.

The condensed water is generated while the humid air is passing through the condenser of the air condensing part, and the condensed water is supplied into the condensed water storing chamber 150 through the drain pipe 160. Alternatively, the water remaining within the laundry keeping space 220 of the cabinet dryer 200 may be supplied into the condensed water storing chamber 150.

As described before, the combination dryer according to each embodiment of the present invention has an advantageous effect that the combination dryer of the present invention is suitable for being built-in, because it makes the air flowing the tumble dryer and the cabinet dryer circulated continuously, not discharged to all outside, thereby not changing interior environment.

Furthermore, the combination dryer of the present invention has an advantageous effect of enhancing an exterior design, because space for being built-in is not necessarily formed large, compared with the total size of the combination dryer.

Still further, the combination dryer of the present invention has an advantageous effect of drying the laundry smoothly, because the moisture in the air may be removed by condensing the humid air discharged from the drying drum and the cabinet dryer and.

That is, the hot air supplied into the tumble dryer and the cabinet dryer becomes dry, thereby enabling the laundry dried more smoothly.

Still further, the combination dryer according to the second and third embodiment of the present invention has an advantageous effect of smoothing out wrinkles and sterilizing the laundry, because a refreshing cycle for the laundry within the cabinet dryer is possible.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A combination dryer, comprising:

a tumble dryer comprising a drum, a hot air supplying pipe configured to flow hot air to the drum, a hot air supplying part configured to heat air within the hot air supplying pipe to generate hot air, and an air condensing part configured to condense the air within the hot air supplying pipe; and a cabinet dryer separated from and disposed adjacent to the tumble dryer and comprising a hot air inlet pipe provided on a top of the tumble dryer and connected with the hot air supplying pipe of the tumble dryer and a laundry keeping space configured to hold laundry therein, and an air outlet pipe configured to guide the air discharged from the laundry keeping space to the hot air supplying pipe.

2. The combination dryer of claim 1, wherein the hot air supplying part comprises a drying heater configured to heat air flowing in the hot air supplying pipe, and a fan configured to forcibly ventilate air within the hot air supplying pipe.

3. The combination dryer of claim 2, wherein the fan is provided in a portion of the drying heater in which air is drawn with respect to a direction of air inflow.

4. The combination dryer of claim 1, wherein the air condensing part has a pipe connected to the hot air supplying part, and comprises a condenser configured to condense the air flowing along the pipe.

5. The combination dryer of claim 4, wherein the air condensing part further comprises an air condensing fan configured to ventilate external air toward the condenser.

6. The combination dryer of claim 1, further comprising a steam generating part provided in at least one of the tumble dryer and the cabinet dryer.

7. The combination dryer of claim 6, wherein an inner space of each of the steam generating part and the cabinet dryer are connected by a steam supplying pipe.

8. The combination dryer of claim 6, wherein the steam generating part comprises:

a water storing chamber configured to store water to generate steam;

a water supplying pipe connected to the water storing chamber configured to receive water from the water storing chamber;

a heating part having a storing space configured to temporarily store the water received through the water supplying pipe; and a heating element provided within the heating part configured to heat and evaporate the stored water into steam.

9. The combination dryer of claim 1 wherein the tumble dryer further comprises a condensed water storing chamber configured to store condensed water generated in the air condensing part as well as the condensed water generated in the cabinet dryer, wherein the condensed water, the air condensing part, and the cabinet dryer are connected by a drain pipe.

10. The combination dryer of claim 9, wherein at least one of the tumble dryer and the cabinet dryer further comprises a steam generating part comprising:

a condensed water supplying pipe configured to receive condensed water from the condensed water storing chamber;

a heating part having a storing space configured to temporarily store water received through the condensed water supplying pipe; and a heating element provided within the heating part configured to heat and evaporate the stored water into steam.

11. The combination dryer of claim 9, further comprising a pump provided in the drain pipe configured to forcibly pump and transmit the condensed water into the condensed water storing chamber.

12. The combination dryer of claim 1, further comprising a filtering part provided in a portion of the hot air supplying pipe where air is drawn from the inside of the drying drum configured to filter foreign substances contained in flowing air.

13. The combination dryer of claim 1, further comprising an air channel valve provided in a portion of each pipe of the hot air supplying pipe connected to the hot air inlet pipe configured to selectively guide a direction of air inflow toward the drying drum and the cabinet dryer.

14. A method of controlling a combination dryer, comprising:

supplying hot air by heating air within a hot air supplying pipe, and supplying the hot air selectively to a drying drum of a tumble dryer and a laundry keeping space of a cabinet dyer separated from and disposed adjacent to the tumble dryer;

condensing humid air discharged from at least one of the drying drum and the laundry keeping space, and making the air dry; and supplying the dry air into the hot air supplying pipe.

15. The method of claim 14, further comprising:

identifying whether an object of a drying cycle is the tumble dryer or the cabinet dryer or both the tumble dryer and the cabinet dryer; and controlling a direction of hot air inflow to supply the hot air to only the identified object of the drying cycle.

16. The method of claim 14, wherein each of the steps is repeatedly performed during a predetermined time period.

17. The method of claim 16, further comprising of reducing a temperature at least one of the drying drum and the laundry keeping space by circulating air not heated by stopping the drying heater when the predetermined time period expires.

18. The method of claim 17, wherein the reducing a temperature step is performed until a temperature of the at least one of the drying drum and the laundry keeping space reaches a predetermined temperature.

19. The method of claim 17, wherein the reducing a temperature step is performed only during an additional predetermined time period.

20. The method of claim 14, further comprising storing condensed water generated during the condensing humid air step.

21. The combination dryer of claim 1, wherein the cabinet dryer is disposed above the tumble dryer.

* * * * *